US011653706B2

(12) United States Patent
Hamdan

(10) Patent No.: US 11,653,706 B2
(45) Date of Patent: May 23, 2023

(54) BRAS AND GARMENTS WITH SUPPORT AND POSITIONING FEATURES

(71) Applicant: Amy Hamdan, Portland, OR (US)

(72) Inventor: Amy Hamdan, Portland, OR (US)

( * ) Notice: Subject to any disclaimer, the term of this patent is extended or adjusted under 35 U.S.C. 154(b) by 756 days.

(21) Appl. No.: 16/410,038

(22) Filed: May 13, 2019

(65) Prior Publication Data

US 2019/0350275 A1 Nov. 21, 2019

Related U.S. Application Data

(60) Provisional application No. 62/672,810, filed on May 17, 2018.

(51) Int. Cl.
*A41C 3/00* (2006.01)
*A41F 1/00* (2006.01)

(52) U.S. Cl.
CPC ..... *A41C 3/0057* (2013.01); *A41C 3/0028* (2013.01); *A41F 1/006* (2013.01)

(58) Field of Classification Search
CPC ..... A41C 3/0028; A41C 3/124; A41C 3/02; A41C 3/10; A41C 3/0021; A41C 3/0057; A41C 3/00
USPC ..... 450/63, 58, 54, 45–46, 59, 61–62, 87
See application file for complete search history.

(56) References Cited

U.S. PATENT DOCUMENTS 2,033,847 A * 3/1936 Moore ..... A41C 3/00 450/61
2,054,986 A * 9/1936 Kunstadter ..... A41C 3/00 450/59
2,067,354 A * 1/1937 Spare ..... A41C 3/0021 450/59
2,100,890 A * 11/1937 Witkower ..... A41C 3/00 450/62
2,115,397 A * 4/1938 Rosenthal ..... A41C 3/00 450/59
2,202,058 A * 5/1940 Malnick ..... A41C 3/00 450/59
2,421,448 A * 6/1947 Witkower ..... A41C 3/0021 450/63
2,484,440 A * 10/1949 Witkower ..... A41C 3/0021 450/59
2,719,303 A * 10/1955 Lodenius ..... A41F 15/02 2/105

(Continued)

FOREIGN PATENT DOCUMENTS

DE 667489 C * 11/1938 ..... A41C 3/00

*Primary Examiner* — Gloria M Hale

(57) ABSTRACT

Bras including an underband, a left shoulder strap, a right shoulder strap, a left support strap having a first end and a second end opposite the first end, the first end of the left support strap being coupled to the left shoulder strap and the second end of the left support strap being coupled to the underband, the left support strap extending from the left shoulder strap to the underband along a path passing between the breasts of the wearer, and a right support strap having a first end and a second end opposite the first end, the first end of the right support strap being coupled to the right shoulder strap and the second end of the right support strap being coupled to the underband, the right support strap extending from the right shoulder strap to the underband along a path passing between the breasts of the wearer.

20 Claims, 6 Drawing Sheets

(56) References Cited

U.S. PATENT DOCUMENTS

| | | | | | |
|---|---|---|---|---|---|
| 2,864,374 | A * | 12/1958 | Verreault | ..... | A41C 3/00<br>450/59 |
| 9,854,852 | B2 * | 1/2018 | Yuasa | ..... | A41C 3/0007 |
| 10,271,584 | B2 * | 4/2019 | Ward | ..... | A41C 3/0021 |
| 2019/0150525 | A1 * | 5/2019 | Arshava | ..... | A41C 3/0064 |

* cited by examiner

BRAS AND GARMENTS WITH SUPPORT AND POSITIONING FEATURES

CROSS REFERENCE TO RELATED APPLICATIONS

This application claims priority to U.S. Application, Ser. No. 62/672,810, filed on May 17, 2018, which is hereby incorporated by reference for all purposes.

BACKGROUND

The present disclosure relates generally to brassieres or bras and garments. In particular, bras and garments with support and positioning features are described.

Sports brassieres (typically referred to as sports bras) are widely worn to support the breasts during sport activities and/or exercise, and typically rely on compression to provide that support. The breasts are pressed back against the chest of the wearer, often by an elasticized front panel stretched between straps that extend over the top of the shoulders and a band encircling the ribs. An underband of reinforced material and/or elastic is generally disposed at a bottom edge of the band. Some sports bras include a wire or other stiffener below the breasts to improve support.

Common complaints associated with conventional sports bras, often arising from the level of compression needed to support the breasts, include discomfort and restriction of the wearer's breathing. Breast tissue can also sometimes be flattened and pressed back under the armpit with currently known bras, causing further discomfort. Underwires or stiffeners present in conventional bras may press painfully into the wearer, and can damage surrounding material of the sports bra. Often with the design of presently known bras, the breasts shift toward the wearer's midline and are thereby pressed together, resulting in discomfort and increased perspiration.

SUMMARY

The present disclosure is directed to bras and garments including an underband, a left shoulder strap, a right shoulder strap, a left support strap having a first end and a second end opposite the first end, the first end of the left support strap being coupled to the left shoulder strap and the second end of the left support strap being coupled to the underband, the left support strap extending from the left shoulder strap to the underband along a path passing between the breasts of the wearer, and a right support strap having a first end and a second end opposite the first end, the first end of the right support strap being coupled to the right shoulder strap and the second end of the right support strap being coupled to the underband, the right support strap extending from the right shoulder strap to the underband along the path passing between the breasts of the wearer.

DETAILED DESCRIPTION

Figure 1:
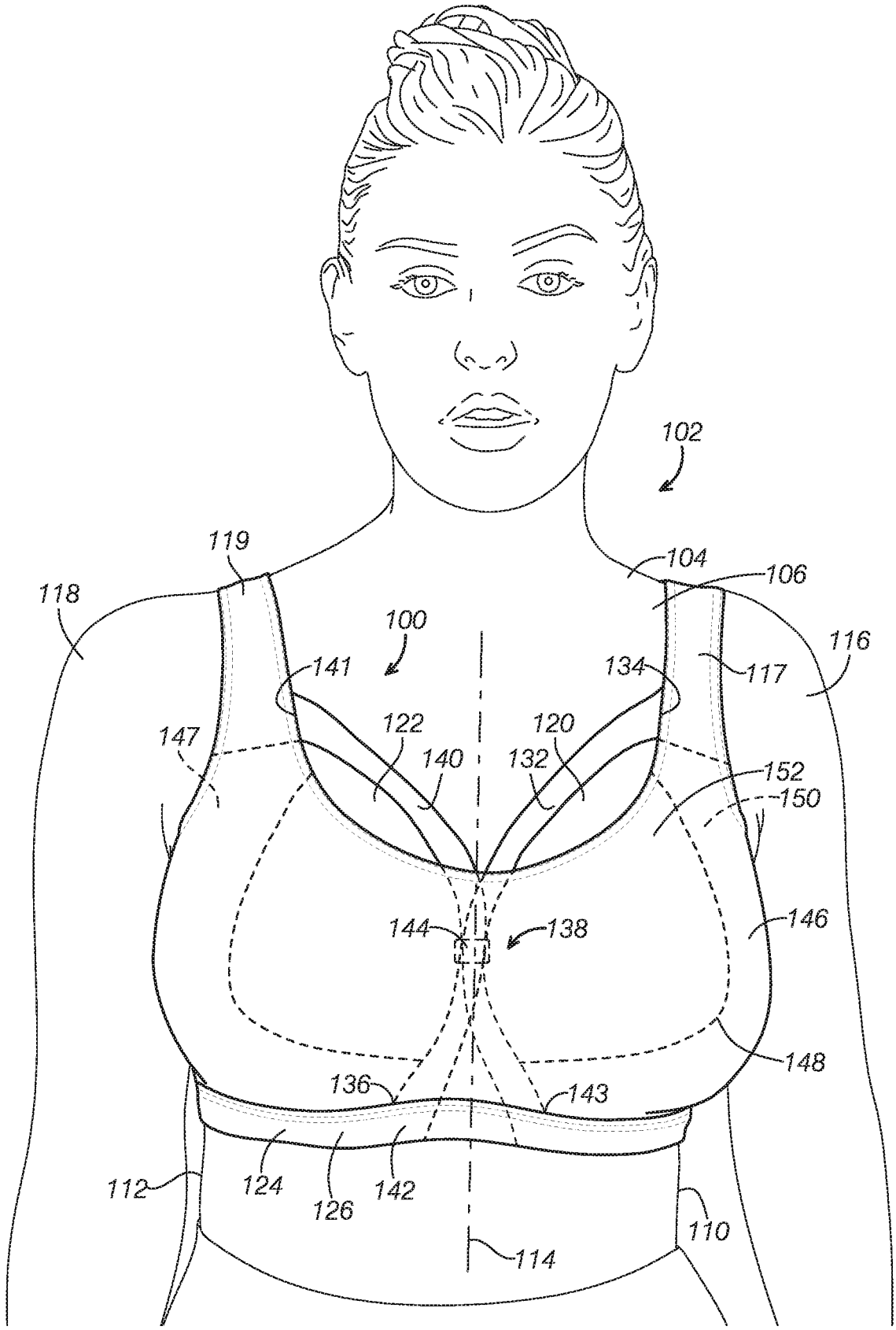
FIG. 1 is a front view of a wearer wearing a bra with obscured anatomy and support and positioning features depicted with dashed lines.

The disclosed bras and garments will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations: however, for the sake of brevity, each and every contemplated variation is not individually described in the following detailed description.

Throughout the following detailed description, examples of various bras and garments are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Bras and Garments with Support and Positioning Features

With reference to FIGS. 1-6, bras and garments with support and positioning features will now be described. For simplicity, this discussion will generally refer to bras instead of bras and garments unless the garment features are being specifically described. The reader should understand that the features discussed below in reference to a bra may also apply to garments with breast support and positioning features.

The bras described herein function to support a wearer's breasts. The bras also function to position the wearer's breasts in a desired position. The bras support and position the breasts during sedentary, routine, and vigorous activities alike. The support and positioning features may be especially useful during vigorous activities like sports, exercise, manual labor, and recreational endeavors.

The reader will appreciate from the figures and description below that the presently described bras address shortcomings of conventional bras. For example, the currently disclosed bras are more comfortable to wear than conventional bras because they do not compress the breasts against the wearer's chest to the same degree as conventional bras. The reduced compression of the present bras also helps to reduce or eliminate breathing restrictions.

Further, the bras discussed herein avoid the pain and discomfort of conventional bras by not pressing the breasts under the wearer's armpits. The pain, discomfort, and material degradation of conventional bras deriving from underwires and stiffeners are addressed by the currently described bras because they effectively support and position the breasts without underwires and siffiners.

The positioning features of the present bras further enhance comfort by not excessively shifting the breasts towards the wearer's midline as occurs with conventional bras. The improved positioning of the currently described bras over conventional bras also helps avoid extra perspiration resulting from the breasts being pressed together. Additionally or alternatively to comfort, the positioning features of the present bras help to maintain a desired position of the breasts for appearance considerations.

Wearer Anatomy

Figure 2:
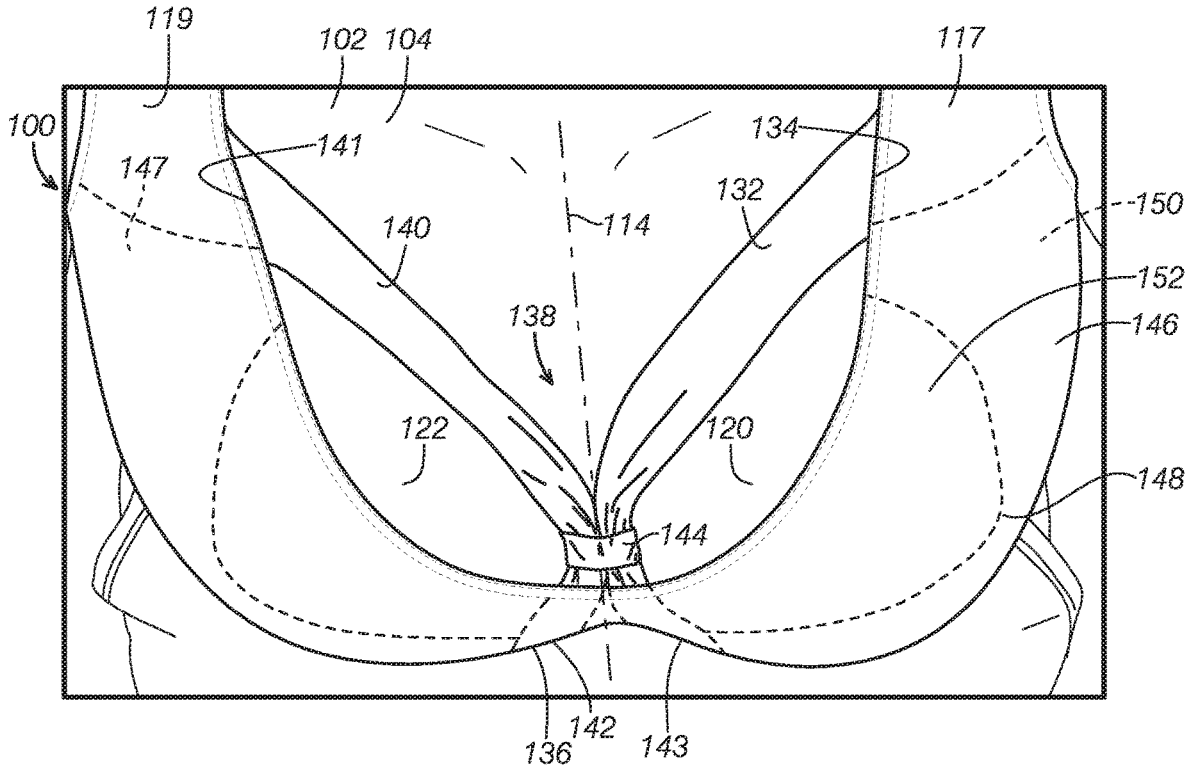
FIG. 2 is a top view of a portion of the wearer and bra shown in FIG. 1 depicting a left support strap urging a right breast of the wearer away from the sagittal midline of the wearer, a left side bolster in dashed lines urging the left breast towards the sagittal midline, a right support strap urging a left breast of the wearer away from the sagittal midline, and a right side bolster urging the right breast towards the sagittal midline.
Figure 6:
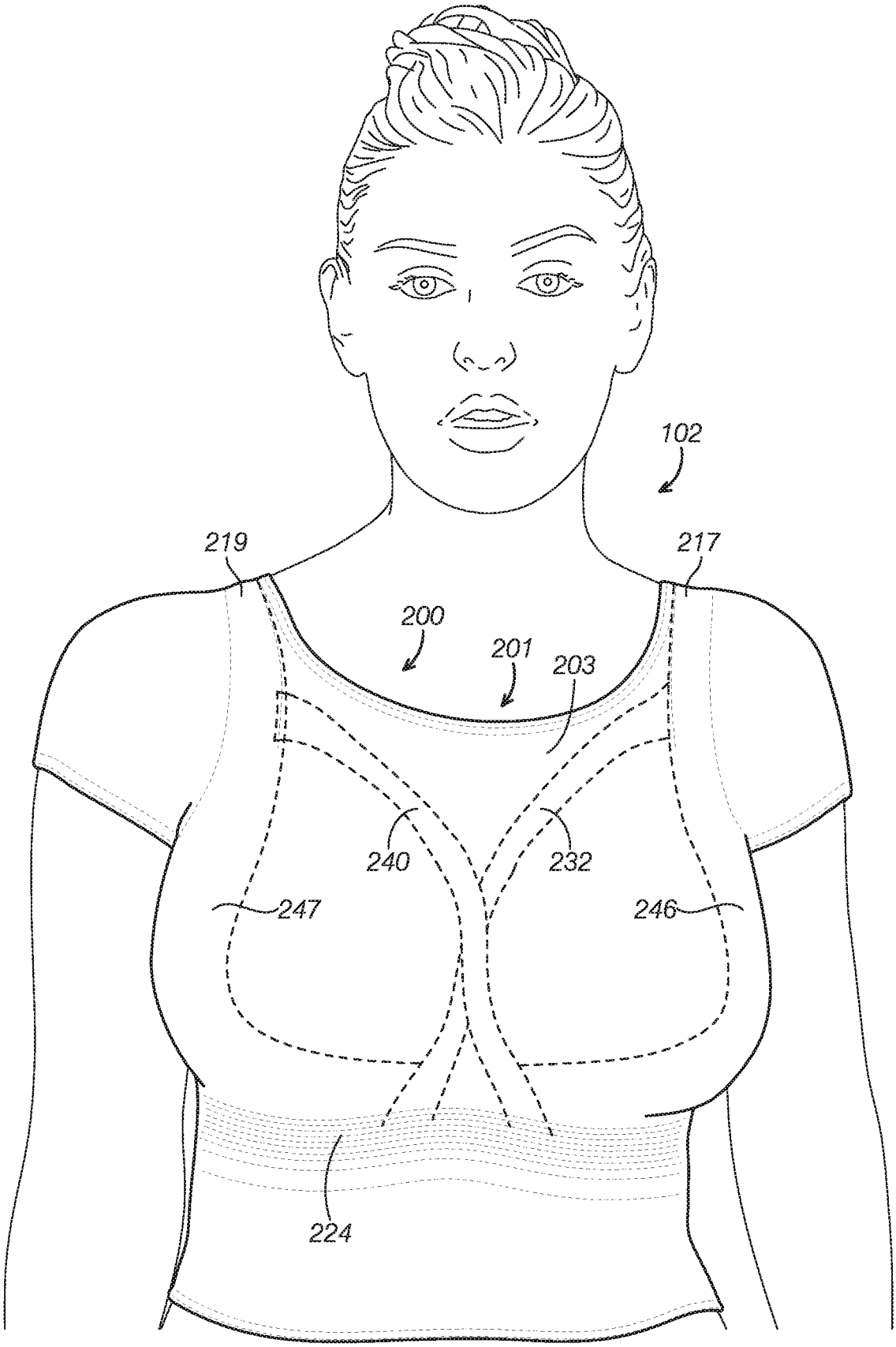
FIG. 6 is a front view of the bra shown in FIG. 1 incorporated into a shirt to define a garment with support and positioning features.

Referencing the anatomy of a user or wearer will aid the discussion of the bra features by orienting the bra features relative to the user's anatomy. In FIGS. 1, 2 and 6 a wearer 102 is depicted wearing a bra 100 in FIGS. 1 and 2 and wearing a garment 201 incorporating a bra 200 in FIG. 6. Relevant anatomy of wearer 102 includes a torso 104, a left shoulder 116, a right shoulder 118, a left breast 120, and a right breast 122.

Torso 104 includes a front torso 106, a back torso (not pictured), a left torso 110, and a right torso 112. An imaginary sagittal midline 114 extends vertically between left torso 110 and right torso 112 and between left breast 120 and right breast 122. An imaginary path 138 passes between left breast 120 and right breast 122 of wearer 102.

Bra Embodiment One

With reference to FIGS. 1-5, a first example of a bra, bra 100, will now be described. Bra 100 includes an underband 124, a left shoulder strap 117, a right shoulder strap 119, a left support strap 132, a right support strap 140, a cinch 144, a left side bolster 146, a right side bolster 147, a rear lateral strap 129, and an outer layer of material 152.

In some examples, the bra does not include one or more features included in bra 100. For example, some bra examples do not include a cinch, left and right side bolsters, a rear lateral strap, and/or an outer layer of material. In some examples, the bra includes a single support strap, such as applications where a wearer has a single breast or desires support and positioning only for a single breast.

In other examples, the bra includes additional or alternative features. For example, some bra examples include an adjustment mechanism for one or more of the straps, including the shoulder straps or the support straps. In certain examples, the bra includes an adjustment mechanism for the underband.

Except where specifically noted, the reader should understand that features described in detail for a left side of the bra will also be present on the right side of the bra. Details for features on the left side and on the right side will generally be the same or highly similar unless differences are specifically discussed below.

Bra 100 functions to support and position left breast 120 and right breast 122 in a comfortable and effective manner that avoids excessive perspiration and facilitates all manner of activities. In particular, bra 100 functions to position each breast in a desired position relative to sagittal midline 114 and relative to the shoulders of wearer 100. Expressed another way, bra functions to support the breasts in a desired horizontal and vertical position where the breasts are separated and held in place without excessive compression against the wearer's chest wall.

Underband

As shown in FIG. 1, underband 124 configured to encircle torso 104 of wearer 102. Underband 124 defines a front portion 126 disposed on front torso 106 of wearer 102 and a back portion 127 disposed on the back torso. The size and shape of the underband may be modified from the examples shown in the figures to suit a given wearer's anatomy, style, or fit preference.

In the present example, underband 124 includes an elastic band configured to resiliently conform to torso 104. In other examples, the underband includes other resilient materials beyond elastic, such as currently known and later developed stretch fabrics. In certain examples, the underband is not resilient and is formed from one or more non-resilient materials. In some versions of the bra, the underband includes an adjustment mechanism enabling the length of the underband to be adjusted to modify the fit of the underband to the user's torso.

Shoulder Straps

With reference to FIGS. 1-5, the reader can see that left shoulder strap 117 is configured to rest on left shoulder 116 of wearer 102 and right shoulder strap 119 is configured to rest on right shoulder 118 of wearer 102. The size and shape of the shoulder straps may be modified from the examples shown in the figures to suit a given wearer's anatomy, style, or fit preference.

The shoulder straps may be any currently known or later developed form of shoulder strap suitable for bras and garments. In some examples, the shoulder straps include adjustment mechanisms enabling the length of the shoulder straps to be adjusted to modify the fit of the straps to the user's shoulders and torso.

Support Straps

As shown in FIGS. 1-4, left support strap 132 has a first end 134 and a second end 136 opposite first end 134. First end 134 of left support strap 132 is coupled to left shoulder strap 117 and second end 136 of left support strap 132 is coupled to front portion 126 of underband 124. As can be seen in FIGS. 1 and 2, left support strap 132 extends from left shoulder strap 117 to front portion 126 of underband 124 along path 138 passing between left breast 120 and right breast 122 of wearer 102.

Similar to left support strap 132, right support strap 140 has a first end 141 and a second end 143 opposite first end 141. As shown in FIGS. 1-4, first end 141 of right support strap 140 is coupled to right shoulder strap 119 and second end 143 of right support strap 140 is coupled to front portion 126 of underband 124. As with left support strap 132, right support strap 140 extends from right shoulder strap 119 to front portion 126 of underband 124 along path 138 passing between left breast 120 and right breast 122 of wearer 102.

Focusing on left support strap 132 for simplicity while recognizing that analogous details and features apply to right support strap 140, a target position 142 of attachment to underband 124 will now be discussed. As can be seen in FIGS. 1-4, second end 136 of left support strap 132 couples to front portion 126 of underband 124 in a target position 142. The reader can see in FIGS. 1 and 2 that target position 142 is disposed underneath right breast 122 of wearer 102 and spaced from sagittal midline 114.

Target position 142 is selected to cause left support strap 132 to urge right breast 122 away from sagittal midline 114 of wearer 102 with a selected amount of force. In other examples where it is desired to urge the right breast away from the sagittal midline with more force than shown in FIGS. 1-4, the target position on the underband is spaced farther from the sagittal midline than target position 142 shown in FIGS. 1-4. In situations where urging the right breast away from the sagittal midline with less force is desired, the target position is selected to be closer to the sagittal midline than target position 142.

Target position 142 is further selected to cause left support strap 132 to urge right breast 122 vertically upwards toward right shoulder 118 of wearer 102 with a selected amount of force. In other examples where it is desired to urge the right breast vertically upwards with more force than shown in FIGS. 1-4, the target position on the underband is spaced farther from the sagittal midline than target position 142 shown in FIGS. 1-4. In situations where urging the right breast vertically upwards with less force is desired, the target position is selected to be closer to the sagittal midline than target position 142.

In this manner, left support strap 132 supports right breast 122 in a desired horizontal and vertical position. Right support strap 140 functions to support and position left breast 120 in a desired horizontal and vertical position in analogous fashion. In some examples, the target position of the straps is wearer adjustable to enable the user to select a desired amount of horizontal and vertical force to exert on the breasts.

In some examples, the target position of the left support strap is positioned underneath the left breast of the wearer instead of underneath the right breast as shown in the figures. In these examples, the left support strap supports the left breast in a desired horizontal and vertical position instead of supporting the right breast in a desired horizontal and vertical position as described above. Correspondingly, the target position for the right support strap may be positioned underneath the right breast of the wearer to supports the right breast in a desired horizontal and vertical position.

As can be seen in FIGS. 1-4, left support strap 132 crosses right support strap 140 as left support strap 132 extends between left shoulder strap 117 and front portion 126 of underband 124. With reference to FIGS. 1 and 2, the reader can see that left support strap 132 crosses right support strap 140 in a position located between left breast 120 and right breast 122 of wearer 102.

Figure 3:
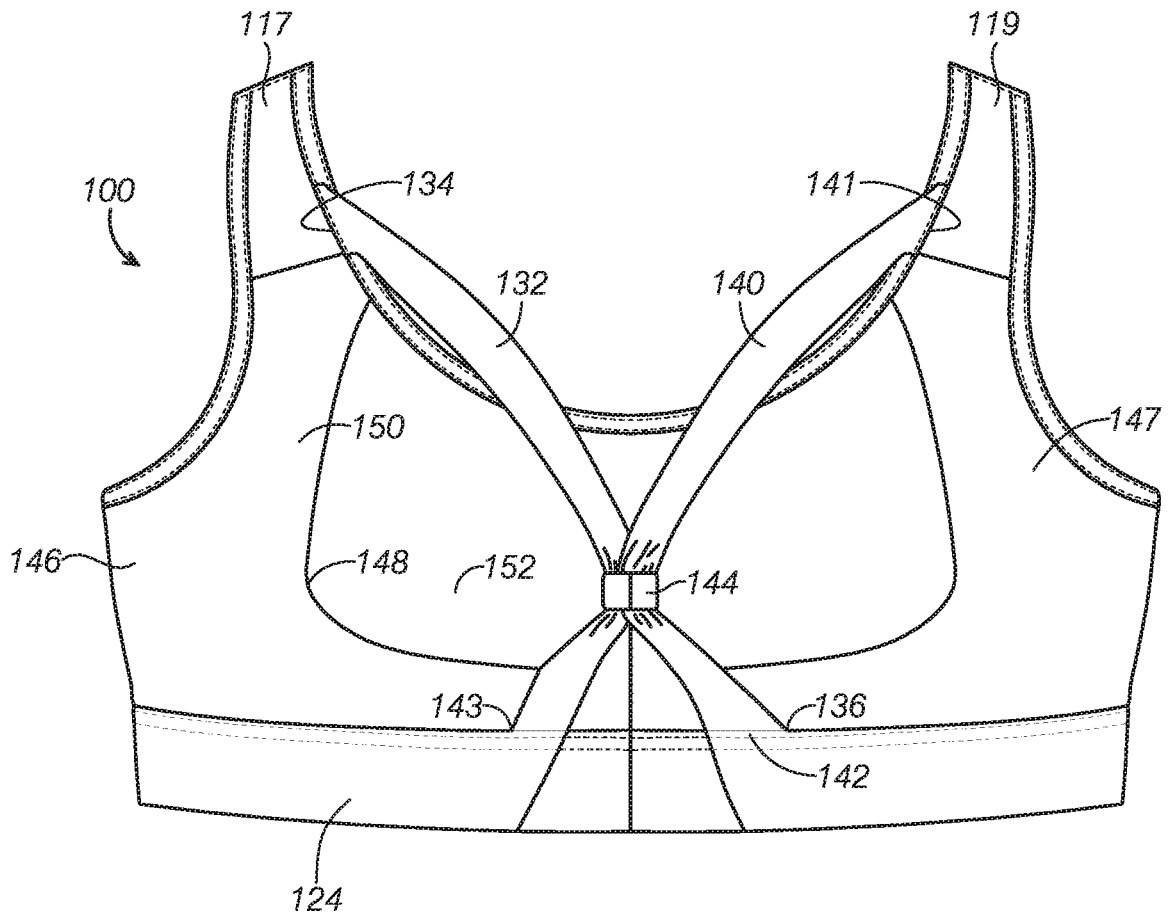
FIG. 3 is a front view of the bra shown in FIG. 1 depicting the bra folded inside out to display a cinch coupling a left support strap to a right support strap.
Figure 4:
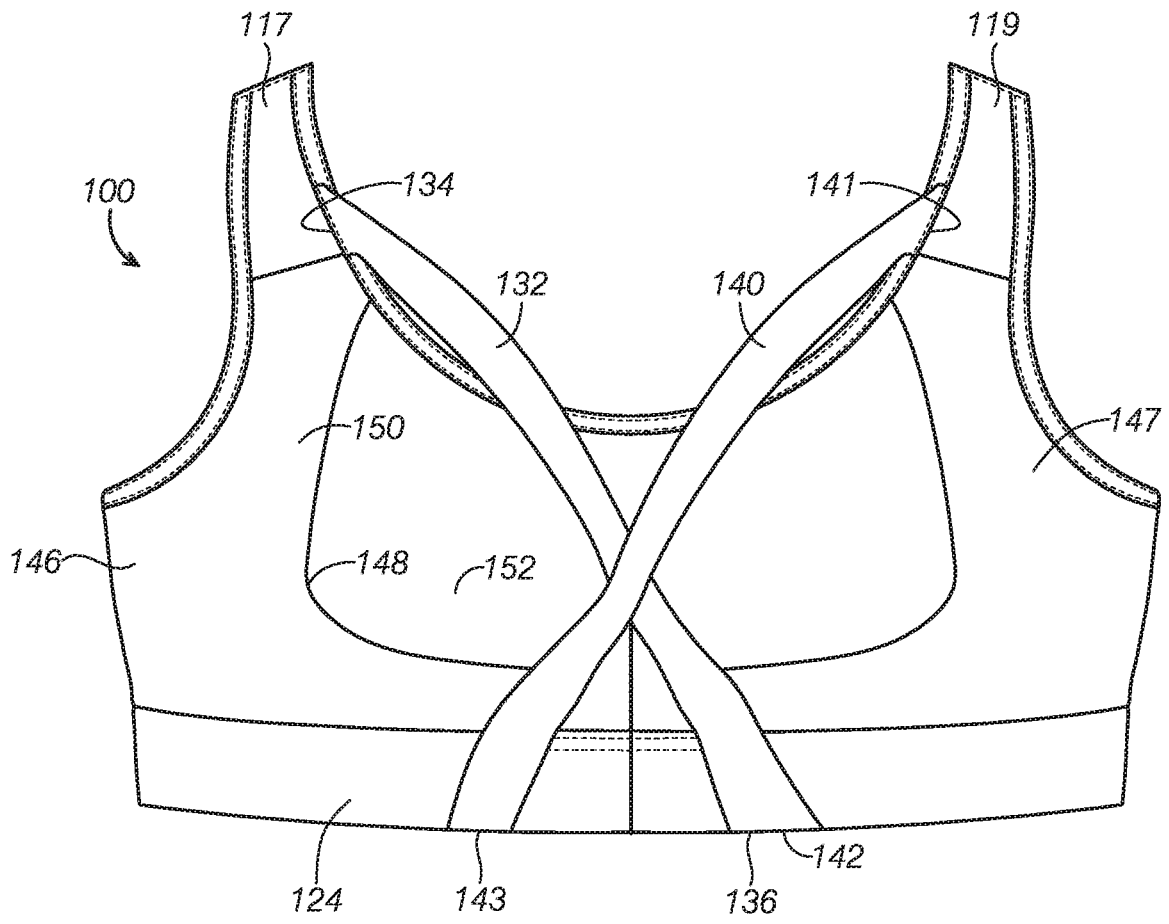
FIG. 4 is a front view of the bra shown in FIG. 1 folded inside out and without the cinch shown in FIG. 3, the left support strap crossing the right support strap.

In the example shown in FIGS. 1-3, left support strap 132 is coupled to right support strap 140 with cinch 144 where left support strap 132 crosses right support strap 140. In other examples, the left support strap is coupled to the right support strap by stitching the straps together, a mechanical fastener, or by the straps being wrapped around each other. In some examples, such as shown in FIG. 4, the straps are not coupled together.

In the example shown in FIGS. 1-3, cinch 144 wraps around left support strap 132 and right support strap 140 in a manner enabling cinch 144 to slide to different longitudinal positions along left support strap 132 and right support strap 140. The position of cinch 144 along the straps can thus be adjusted to suit a user's preference.

Side Bolsters

With reference to FIGS. 1-5, the reader can see that bra 100 includes left side bolster 146 and right side bolster 147 to support and position left breast 120 and right breast 122, respectively. The discussion that follows will focus on left side bolster 146 with the understanding that the structure, details, and function of right side bolster 147 is the same as or a mirror image of left side bolster 146.

As shown in FIGS. 1-4, left side bolster 146 extends from left torso 110 of wearer 102 to front torso 106 of wearer 102. Left side bolster 146 is coupled to left shoulder strap 117 and to underband 124. In the particular example shown in FIGS. 1-5, left side bolster 146 is formed from a stretch fabric 150. In other examples, fabric not configured to stretch to a significant degree is used instead.

In the present example, left side bolster 146 has a substantially L-shaped profile. In other examples, the left side bolster has different shapes than shown in FIGS. 1-4. The L-shaped profile of the present example results from left side bolster 146 being proximate sagittal midline 114 near left shoulder strap 117, spaced from sagittal midline 114 between left shoulder strap 117 and underband 124, and proximate sagittal midline 114 near underband 124.

The reader can see in FIGS. 1-4 that the spacing between left side bolster 146 and sagittal midline 114 initially increases as left side bolster 146 and extends away from left shoulder strap 117. The spacing between left side bolster 146 sagittal midline 114 increases until an apex position 148 is reached and then the spacing begins to decrease. As shown in FIGS. 1-4, apex position 148 is located between left shoulder strap 117 and underband 124. With reference to FIGS. 1 and 2, the L-shaped profile of left side bolster 146 causes left side bolster 146 to contact lateral and inferior portions of left breast 120 of wearer 102 without contacting the majority of medial and superior portions of left breast 120 of wearer 102.

With continued reference to FIGS. 1 and 2, left side bolster 146 urges left breast 120 towards sagittal midline 114. In the present example, left side bolster 146 cooperates with right support strap 140 to position left breast 120 in a central position by urging left breast 120 towards sagittal midline 114. By urging left breast 120 towards sagittal midline 114, left side bolster 146 serves to counterbalance right support strap 140 urging left breast 120 away from sagittal midline 114.

In addition to the lateral support and positioning just described, left side bolster 146 further urges left breast 120 towards left shoulder strap 117. In this manner, left side bolster 146 assists right support strap 140 to vertically position left breast 120 in a desired position.

Rear Lateral Strap

Figure 5:
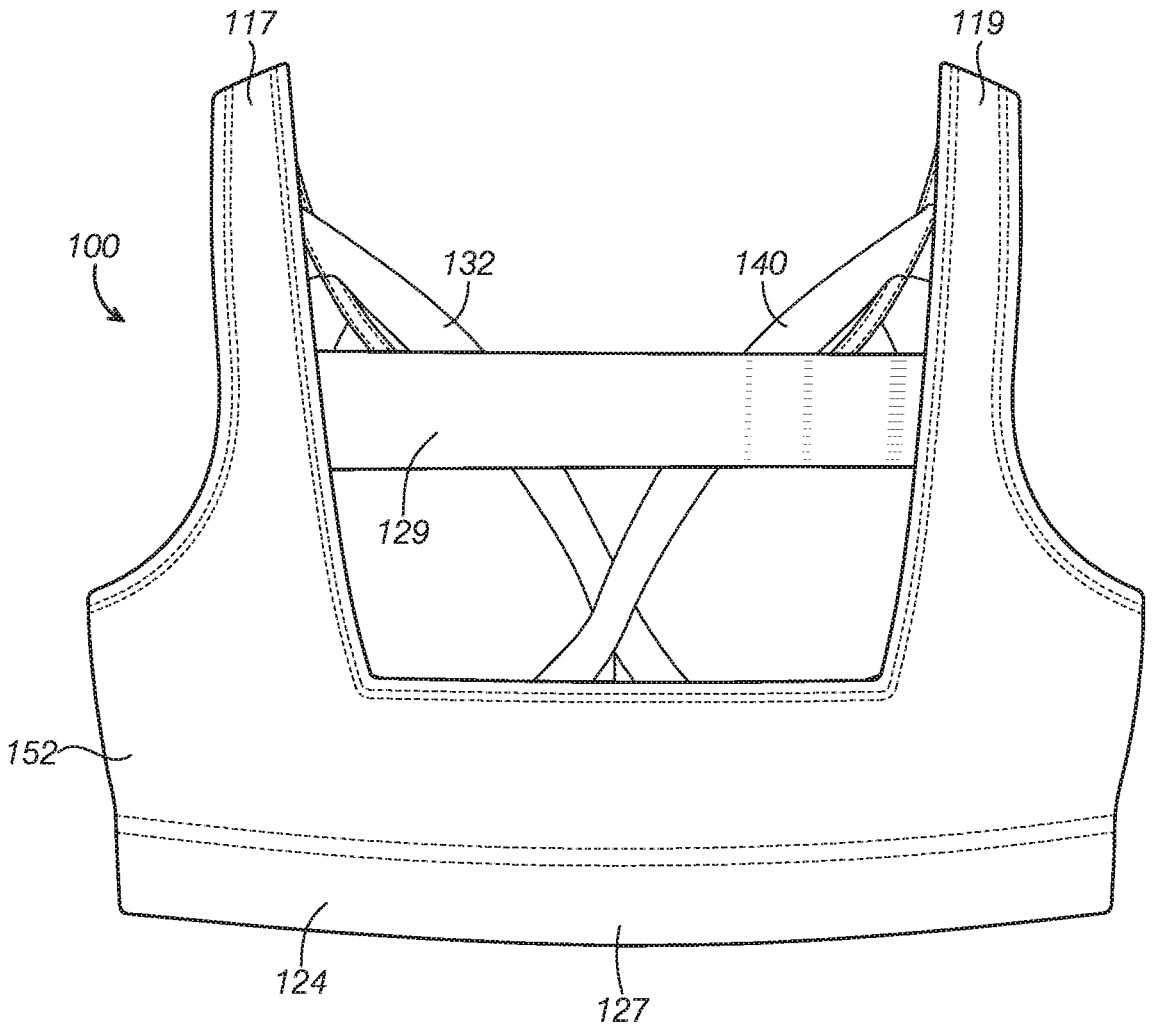
FIG. 5 is a rear view of the bra shown in FIG. 1.

As shown in FIG. 5, bra 100 includes rear lateral strap 129 in a position overlying the rear torso when bra 100 is worn. Rear lateral strap 129 extends between left shoulder strap 117 and right shoulder strap 119. In the present example, rear lateral strap 129 includes elastic and, in other examples, is formed from stretch fabrics or non-resilient fabrics. The rear lateral strap is an optional feature that functions to restrict the shoulder straps from moving apart and to resiliently urge the shoulder straps to return to the resting position shown in FIG. 5.

Outer Material

As shown in FIGS. 1-5, bra 100 includes an outer layer of material 152 covering certain other components of bra 100. A portion of outer layer of material 152 is coupled to left shoulder strap 117 and to underband 124 and covers left side bolster 146. In the present example, outer layer of material 152 covers or conceals at least portions of left shoulder strap 117, right shoulder strap 119, left support strap 132, right support strap 140, cinch 144, left side bolster 146, right side bolster 147, and underband 124. In other examples, the outer layer of material is omitted or covers fewer of the components covered by outer layer of material 152.

Any currently known or later developed fabric or material suitable for bras and garments may be used. For example, cotton fabrics, synthetic fabrics, stretch fabrics, and moisture wicking fabrics are all suitable.

Bra Embodiment Two

Turning attention to FIG. 6, a second example of a bra, bra 200, will now be described. Bra 200 includes many similar or identical features to bra 100. Thus, for the sake of brevity, each feature of bra 200 will not be redundantly explained. Rather, key distinctions between bra 200 and bra 100 will be described in detail and the reader should reference the discussion above for features substantially similar between the two bras.

As can be seen in FIG. 6, bra 200 includes an underband 224, a left shoulder strap 217, a right shoulder strap 219, a left support strap 232, a right support strap 240, a left side bolster 246, a right side bolster 247, and an outer layer of material in the form of a shirt 203. Incorporating bra 200 into shirt 203 defines a garment 201. Garment 201 supports and positions the breasts in the same manner described above for bra 100.

In the FIG. 6 example, garment 201 is a shirt providing breast support and the garment takes different forms in other examples. For example, the garment incorporating the bras described herein may take the form of swimwear, athletic apparel, shirts, dresses, pajamas, camisoles, bodysuits, unitards, and the like.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A bra to be worn by a wearer, the bra comprising:

an underband configured to encircle a torso of the wearer, the underband defining a front portion configured to be disposed on a front torso of the wearer;

a left shoulder strap configured to rest on a left shoulder of the wearer;

a right shoulder strap configured to rest on a right shoulder of the wearer;

a left support strap having a first end and a second end opposite the first end, the first end of the left support strap being directly coupled to the left shoulder strap and the second end of the left support strap being directly coupled to the front portion of the underband in a target position, the left support strap configured to extend from the left shoulder strap to the front portion of the underband along a path passing between a left breast and a right breast of the wearer, wherein the left support strap is configured to urge the right breast away from a sagittal midline of the wearer and vertically upwards toward the right shoulder of the wearer with a selected amount of force, and wherein the left support strap is configured to support the right breast in a desired vertical and horizontal position; and a right support strap having a first end and a second end opposite the first end, the first end of the right support strap being directly coupled to the right shoulder strap and the second end of the right support strap being directly coupled to the front portion of the underband in another target position, the right support strap configured to extend from the right shoulder strap to the front portion of the underband along the path passing between the left breast and the right breast of the wearer, wherein the right support strap is configured to urge the left breast away from the sagittal midline of the wearer and vertically upwards toward the left shoulder of the wearer with a selected amount of force, and wherein the right support strap is configured to support the left breast in another desired vertical and horizontal position.

2. The bra of claim 1, wherein the target position for the left support strap is configured to be disposed underneath the right breast of the wearer and spaced from a sagittal midline extending vertically between a left torso and a right torso of the wearer.

3. The bra of claim 1, wherein the another target position for the right support strap is configured to be disposed underneath the left breast of the wearer and spaced from a sagittal midline extending vertically between a left torso and a right torso of the wearer.

4. The bra of claim 1, wherein the left support strap crosses the right support strap as the left support strap extends between the left shoulder strap and the front portion of the underband.

5. The bra of claim 4, wherein the left support strap is configured to cross the right support strap in a position located between the left breast and the right breast of the wearer.

6. The bra of claim 5, wherein the left support strap is coupled to the right support strap where the left support strap crosses the right support strap.

7. The bra of claim 6, further comprising a cinch positioned where the left support strap crosses the right support strap, the cinch coupling the left support strap to the right support strap.

8. The bra of claim 7, wherein the cinch wraps around the left support strap and the right support strap in a manner enabling the cinch to slide to different longitudinal positions along the left support strap and the right support strap.

9. The bra of claim 1, further comprising a left side bolster configured to extend from a left torso of the wearer to the front torso of the wearer, the left side bolster being directly coupled to the left shoulder strap and to the underband.

10. The bra of claim 9, wherein the left side bolster is configured to urge the left breast of the wearer towards a sagittal midline extending vertically between the left torso and a right torso of the wearer.

11. The bra of claim 10, wherein the left side bolster is configured to cooperate with the right support strap to position the left breast in a central position by urging the left breast of the wearer towards the sagittal midline of the wearer to counterbalance the right support strap urging the left breast of the wearer away from the sagittal midline.

12. The bra of claim 11, wherein the left side bolster further configured to urge the left breast of the wearer towards the left shoulder strap and to assist the right support strap to vertically position the left breast of the wearer.

13. The bra of claim 9, wherein the left side bolster has a substantially L-shaped profile resulting from being configured to be:

proximate a sagittal midline extending vertically between the left torso and a right torso of the wearer proximate the left shoulder strap, spaced from the sagittal midline between the left shoulder strap and the underband, and proximate the sagittal midline proximate the underband.

14. The bra of claim 13, wherein the spacing between the left side bolster and the sagittal midline increases as the left side bolster extends away from the left shoulder strap until an apex position between the left shoulder strap and the underband where the spacing between the left side bolster and the left shoulder strap begins to decrease.

15. The bra of claim 14, wherein the L-shaped profile of the left side bolster is configured to cause the left side bolster to contact lateral and inferior portions of the left breast of the wearer without contacting the majority of medial and superior portions of the left breast of the wearer.

16. The bra of claim 9, further comprising an outer layer of material coupled to the left shoulder strap and to the underband, the outer layer of material covering the left side bolster.

17. The bra of claim 1 incorporated into a shirt to define a garment providing breast support.

18. A bra to be worn by a wearer, the bra comprising:

an underband configured to encircle a torso of the wearer, the underband defining a front portion configured to be disposed on a front torso of the wearer;

a left shoulder strap configured to rest on a left shoulder of the wearer;

a right shoulder strap configured to rest on a right shoulder of the wearer;

a left support strap having a first end and a second end opposite the first end, the first end of the left support strap being directly coupled to the left shoulder strap and the second end of the left support strap being directly coupled to the front portion of the underband in a target position, the left support strap configured to extend from the left shoulder strap to the front portion of the underband along a path passing between a left breast and a right breast of the wearer, wherein the left support strap is configured to urge the right breast away from a sagittal midline of the wearer and vertically upwards toward the right shoulder of the wearer with a selected amount of force, and wherein the left support strap is configured to support the right breast in a desired vertical and horizontal position;

a right support strap having a first end and a second end opposite the first end, the first end of the right support strap being directly coupled to the right shoulder strap and the second end of the right support strap being directly coupled to the front portion of the underband in another target position, the right support strap configured to extend from the right shoulder strap to the front portion of the underband along the path passing between the left breast and the right breast of the wearer, wherein the right support strap is configured to urge the left breast away from the sagittal midline of the wearer and vertically upwards toward the left shoulder of the wearer with a selected amount of force, and wherein the right support strap is configured to support the left breast in another desired vertical and horizontal position;

a left side bolster configured to extend from a left torso of the wearer to the front torso of the wearer, the left side bolster being directly coupled to the left shoulder strap and to the underband; and a right side bolster configured to extend from a right torso of the wearer to the front torso of the wearer, the right side bolster being directly coupled to the right shoulder strap and to the underband.

19. A bra to be worn by a wearer, the bra comprising:

an underband configured to encircle a torso of the wearer, the underband defining a front portion configured to be disposed on a front torso of the wearer;

a left shoulder strap configured to rest on a left shoulder of the wearer;

a right shoulder strap configured to rest on a right shoulder of the wearer;

a left support strap having a first end and a second end opposite the first end, the first end of the left support strap being directly coupled to the left shoulder strap and the second end of the left support strap directly couples to the front portion of the underband in a target position, the target position configured to be disposed underneath the left breast of the wearer and spaced from a sagittal midline of the torso of the wearer, the left support strap configured to extend from the left shoulder strap to the front portion of the underband along a path passing between a left breast and a right breast of the wearer, wherein the left support strap is configured to urge the left breast away from a sagittal midline of the wearer and vertically upwards toward the left shoulder of the wearer with a selected amount of force, and wherein the left support strap is configured to support the left breast in another desired vertical and horizontal position; and a right support strap having a first end and a second end opposite the first end, the first end of the right support strap being directly coupled to the right shoulder strap and the second end of the right support strap being directly coupled to the front portion of the underband in another target position, the another target position configured to be disposed underneath the right breast of the wearer and spaced from a sagittal midline of the torso of the wearer, the right support strap configured to extend from the right shoulder strap to the front portion of the underband along the path passing between the left breast and the right breast of the wearer, wherein the right support strap is configured to urge the right breast away from the sagittal midline of the wearer and vertically upwards toward the right shoulder of the wearer with a selected amount of force, and wherein the right support strap is configured to support the right breast in another desired vertical and horizontal position.

20. The bra of claim 19, wherein the target position for the left support strap is configured to be disposed underneath the left breast of the wearer and spaced from a sagittal midline extending vertically between a left torso and a right torso of the wearer, and wherein the another target position for the right support strap is configured to be disposed underneath the right breast of the wearer and spaced from a sagittal midline extending vertically between a left torso and a right torso of the wearer.

* * * * *